US006334725B1

(12) United States Patent
Miyauchi

(10) Patent No.: US 6,334,725 B1
(45) Date of Patent: Jan. 1, 2002

(54) DRIVE TRANSMITTING APPARATUS AND IMAGE FORMING APPARATUS

(75) Inventor: Yasuo Miyauchi, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/638,887

(22) Filed: Aug. 16, 2000

(30) Foreign Application Priority Data

Aug. 20, 1999 (JP) ..... 11-233803
Jul. 31, 2000 (JP) ..... 12-231326

(51) Int. Cl.[7] ..... B41J 11/58

(52) U.S. Cl. ..... 400/624; 400/629; 271/10.13; 271/147; 74/435; 74/448

(58) Field of Search ..... 74/409, 411.5, 74/412 R, 413, 435, 448, 462; 271/10.13, 114, 147; 400/624, 629, 636, 636.2

(56) References Cited

U.S. PATENT DOCUMENTS 4,723,129 A 2/1988 Endo et al.
4,740,796 A 4/1988 Endo et al.
4,990,011 A * 2/1991 Underwood et al. ..... 400/636
5,672,019 A * 9/1997 Hiramatsu et al. ..... 400/624
5,738,453 A * 4/1998 Tsuburaya et al. ..... 400/624
5,895,038 A * 4/1999 Takashima ..... 271/114
5,927,705 A * 7/1999 Becker et al. ..... 271/114
5,944,305 A * 8/1999 Takashima et al. ..... 271/127

FOREIGN PATENT DOCUMENTS

| | | |
|---|---|---|
| EP | 0 856 777 | 8/1998 |
| JP | 9-141966 | 6/1997 |
| JP | 10-274312 | 10/1998 |

* cited by examiner

*Primary Examiner*—Ren Yan
(74) *Attorney, Agent, or Firm*—Fitzpatrick, Cella, Harper & Scinto

(57) ABSTRACT

In a drive transmitting apparatus for selectively transmitting a driving force from a drive source to a driving member through clutch means to achieve a positive switching operation, the clutch means includes an output gear having a non-entirely toothed portion not including a predetermined number of teeth in a tooth width-wise direction and an entirely toothed portion having no non-toothed portion, a gear opposed to the non-toothed portion of the output gear and rotated by a driving force, a trigger gear meshed with the entirely toothed portion of the output gear and freely rotatable with respect to a shaft and movable in a thrust direction, and ratchet portions formed on opposed side surfaces of the gear and the trigger gear so that, when the trigger gear is slid in the thrust direction to engage the ratchet portions by each other, a driving force is transmitted from the gear to the output gear.

10 Claims, 8 Drawing Sheets

613a
612a
612
622a
622
621
619
620
620a
613
623
619a
612
613
622a
622
621
620
620a
619
630
630a
632a
632
635
616
630
632
635
670
616
630a
632a
635
670
616c
616
630
632
634
635
616

DRIVE TRANSMITTING APPARATUS AND IMAGE FORMING APPARATUS

BACKGROUND OF THE INVENTION

1. Field of the Invention

The present invention relates to a drive transmitting apparatus for selectively transmitting a driving force from a drive source to a driving member through clutch means and an image forming apparatus using such a drive transmitting apparatus.

2. Related Background Art

Among drive transmitting mechanisms for image forming apparatuses, there is a mechanism in which a partially non-toothed gear having a non-toothed portion is used as clutch means for effecting connection and disconnection of a driving force, as disclosed in Japanese Patent Application Laid-open No. 10-274312. According to this mechanism, in a normal condition, the non-toothed portion is opposed to a drive gear to block transmission of the driving force to the partially non-toothed gear, and, when the partially non-toothed gear is slightly rotated by trigger means such as a solenoid, the drive gear is engaged by the partially non-toothed gear, thereby transmitting the driving force to the partially non-toothed gear. When the partially non-toothed gear is rotated by one revolution, since the transmission of the driving force is blocked again by the non-toothed portion, this mechanism acts as a one revolution controlling clutch.

On the other hand, as disclosed in Japanese Patent Application Laid-open No. 9-141966, there is an apparatus in which a driving force is switched by connecting a disconnecting clutch means of a driving system by utilizing a movement of a carriage. In this apparatus, a pair of clutch gears having triangular teeth (ratchets) formed on opposed side surfaces and engageable with each other are provided, and, when one of the clutch gears is pushed toward the other clutch gear by the carriage, the triangular teeth are engaged by each other, thereby transmitting a driving force. According to this arrangement, a construction in which one of the clutch gears is pushed by using a solenoid is not required, and trigger for transmitting the driving force can be achieved by using the movement of the carriage itself, thereby reducing the cost.

However, in the above-mentioned conventional technique, when the drive gear begins to be engaged by the partially non-toothed gear, the tops of the teeth may abut against each other to cause poor engagement, with the result that noise may be generated or an out-of-phase condition of a motor may be caused. In the technique disclosed in Japanese Patent Application Laid-open No. 10-274312, although special tooth configurations in which inclined surfaces are formed on the teeth are adopted to avoid such inconvenience, it is difficult to set the optimum tooth configurations.

On the other hand, in the technique disclosed in Japanese Patent Application Laid-open No. 9-141966, as shown in FIG. 9, a trigger tooth portion 901*b* complementary to the non-toothed portion is provided aside the non-toothed portion 901*a* of the partially non-toothed gear 901, and the drive gear 902 is opposed to the non-toothed portion 901*a* and a driven gear 903 is disposed in an engagement relationship to the trigger tooth portion 901*b*.

The driven gear 903 has no self-driving ability and can be moved in a thrust direction so as to contact with and separate from the drive gear 902. When the driven gear 903 is urged against the drive gear 902, the opposed triangular teeth (not shown) engageable with each other are meshed with each other, thereby transmitting the driving force of the drive gear 902 to the driven gear 903. As a result, the driving force from the drive gear 902 is transmitted to the partially non-toothed gear 901 through the driven gear 903, thereby starting rotation of the partially non-toothed gear 901. When the partially non-toothed gear 901 is rotated by a predetermined amount, the drive gear 902 is engaged by a toothed portion 901*c* of the partially non-toothed gear 901, with the result that, even when the urging of the driven gear 903 against the drive gear 902 is released, the driving force can be transmitted. In this case, so long as the phases of the gear portions of the gears 902, 903 in a condition that the triangular teeth are engaged by each other are aligned with each other, since the tooth of the drive gear 902 is smoothly engaged by the toothed portion 901*c* of the partially non-toothed gear 901, the tops of the teeth of both gears are prevented from abutting against each other to cause the poor engagement.

However, immediately before the partially non-toothed gear 901 is rotated by one revolution to return to its initial position again, when the driven gear 903 freely rotatable without transmission of the driving force due to disconnection of the triangular tooth from the triangular tooth of the drive gear 903 is engaged by the trigger tooth portion 901*b* again, the tops of the teeth of the driven gear 903 and the trigger tooth portion 901*b* may abut against each other to cause poor engagement.

In this case, so long as a condition that the driven gear 903 is urged against the drive gear 902 is maintained while the partially non-toothed gear 901 is rotated by one revolution, since the phases of the gears can be aligned even when the driven gear 903 and the trigger tooth portion 901*b* are engaged by each other again, this problem can be solved. However, meanwhile, the carriage must be retained in a predetermined position for urging the driven gear 903 against the drive gear 902, thereby delaying the further recording operation.

SUMMARY OF THE INVENTION

The present invention aims to eliminate the above-mentioned conventional drawbacks, and an object of the present invention is to provide a drive transmitting apparatus in which a positive switching operation can be achieved without noise and/or poor drive transmission from a drive source, and an image forming apparatus using such a drive transmitting apparatus.

Another object of the present invention is to provide a drive transmitting apparatus comprising an output gear having a non-toothed portion not including a predetermined number of teeth and an entirely toothed portion having no non-toothed portion in a tooth width-wise direction, an input gear disposed at a position where it can be opposed to the non-toothed portion of the output gear and rotated by a driving force from a drive source, a trigger gear meshed with the entirely toothed portion of the output gear and rotatable with respect to a rotary shaft and movable in a thrust direction so as to contact with and separate from the output gear, and engagement portions provided on opposed side surfaces of the input gear and the trigger gear and engageable with each other, and wherein, when the input gear and the trigger gear are engaged by each other through the engagement portions, the driving force from the drive source is selectively transmitted to a driving member through clutch means for synchronizing phases of the input gear and the trigger gear, and an image forming apparatus using such a drive transmitting apparatus.

A further object of the present invention is to provide a drive transmitting apparatus in which a positive switching operation can be achieved without noise and/or poor drive transmission from a drive source by providing a construction in which tops of teeth of an input gear and an output gear do not abut against each other by aligning phases of engagement portions of the input gear and a trigger gear, and an image forming apparatus using such a drive transmitting apparatus.

A still further object of the present invention is to provide a drive transmitting apparatus in which engagement portions of two gears are constituted by ratchets having relative symmetrical configurations and engageable with each other so that, when phases of two gears are aligned, a gap is created between the ratchets.

DETAILED DESCRIPTION OF THE PREFERRED EMBODIMENTS

Now, an image forming apparatus using a drive transmitting apparatus according to an embodiment of the present invention will be explained with reference to the accompanying drawings.

[First Embodiment]

Here, an entire construction of the image forming apparatus will first be described, and then, the drive transmitting apparatus will be described. (Construction of image forming apparatus)

Figure 1:
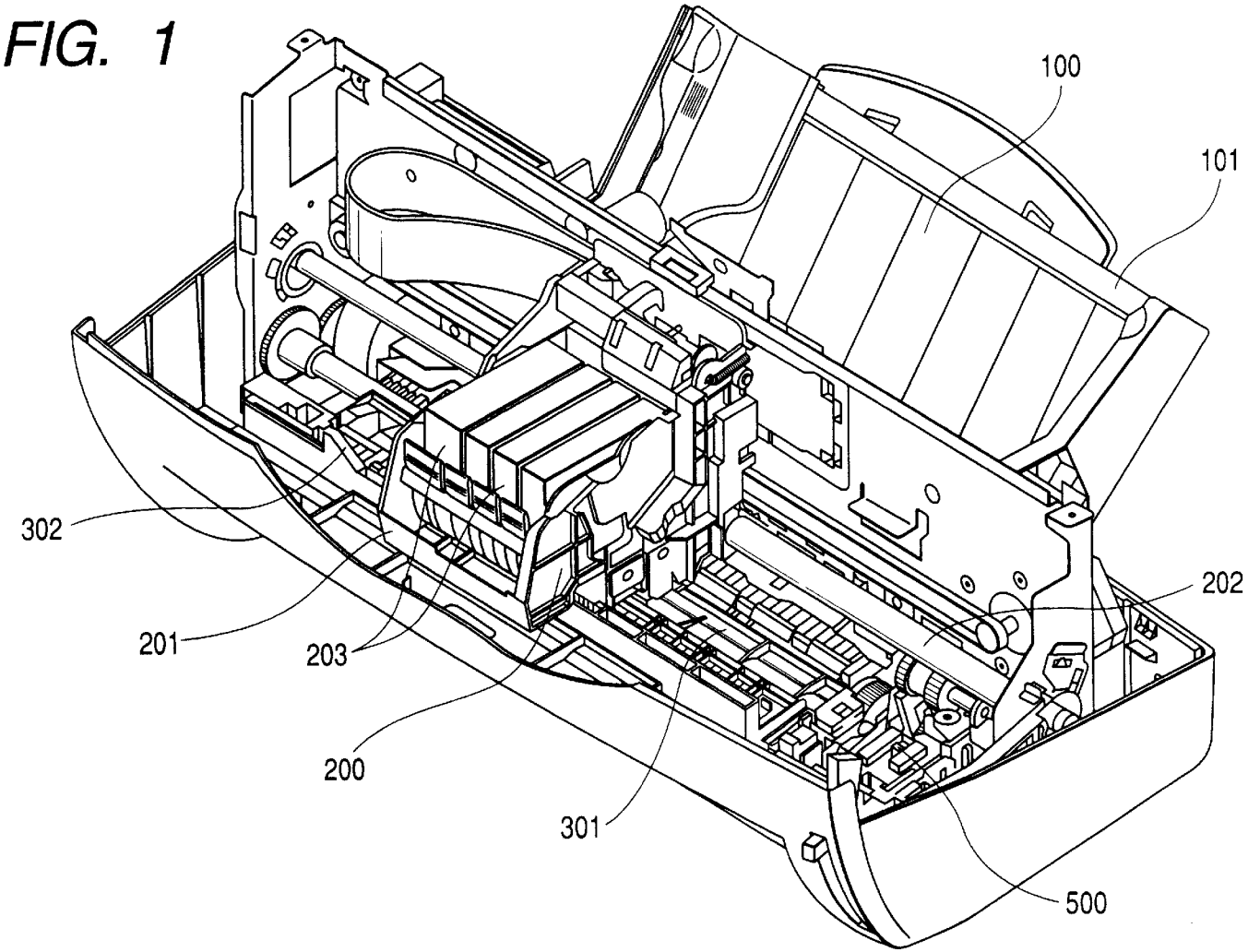
FIG. 1 is a perspective view showing an ink jet printer according to a first embodiment of the present invention.
Figure 2:
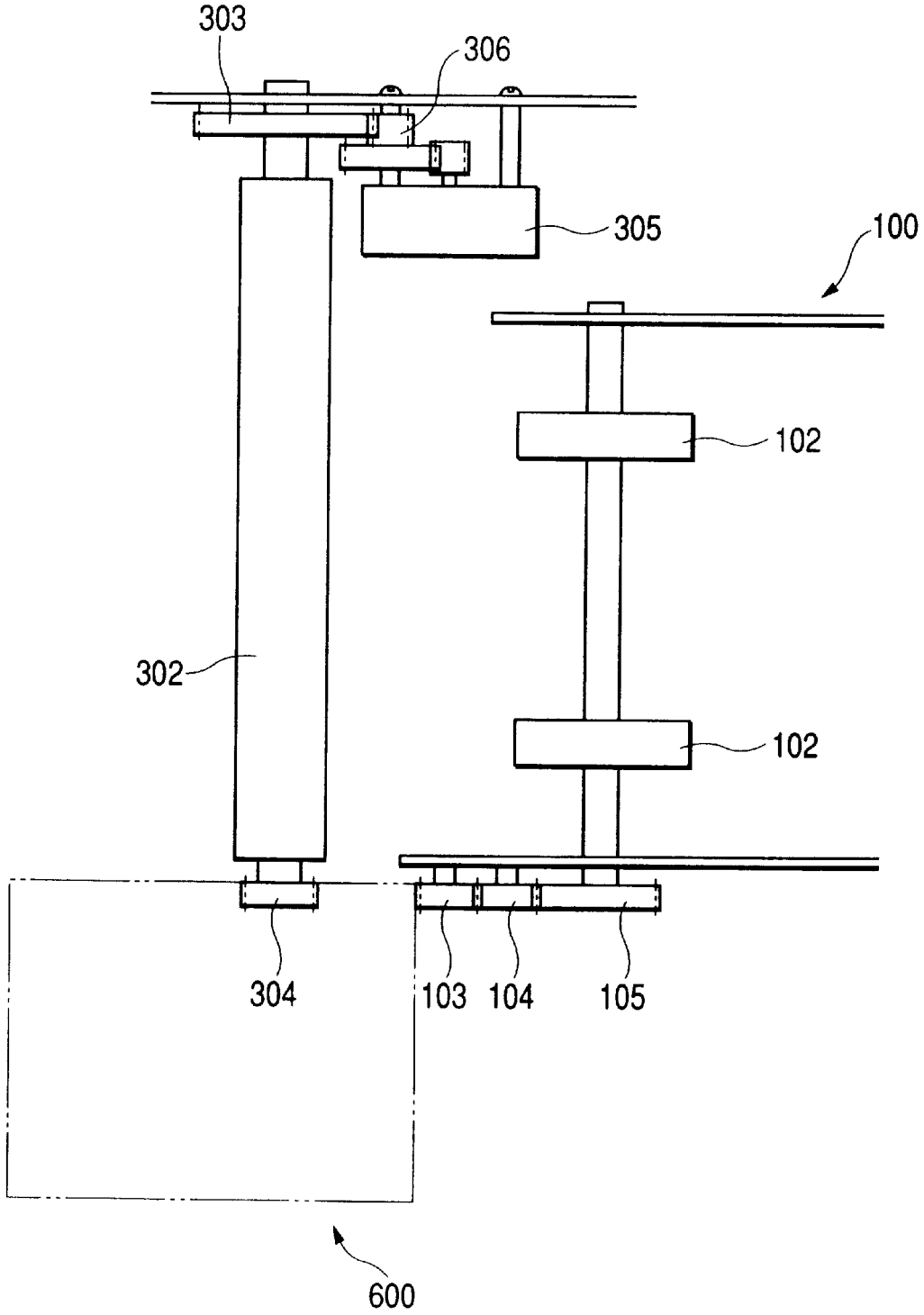
FIG. 2 is a schematic plan view of a sheet feeding mechanism.

FIG. 1 is a perspective view showing an ink jet printer according to the first embodiment of the present invention, and FIG. 2 is a schematic plan view of a sheet feeding mechanism.

In FIGS. 1 and 2, sheet feeding means 100 serve to separate and feed sheets stacked on a stacking tray 101 one by one by rotating a sheet feeding roller 102. The sheet fed by the sheet feeding means 100 is conveyed onto a platen 301 by a conveying roller 302 forming a part of conveying means. After recording is effected on the sheet by recording means 200, the sheet is discharged out of the printer.

The recording means 200 according to the illustrated embodiment are of serial ink jet recording type in which a carriage 201 is reciprocally movable along a guide shaft 202 and an ink cartridge 203 integrally including a recording head and an ink tank is mounted on the carriage 201. By discharging ink from the recording head in response to a shifting movement of the carriage 201, an ink image is formed on the sheet (recording medium) conveyed to a recording area defined between the opposed carriage 201 and platen 301. Incidentally, at an end of a shifting range of the carriage 201, recovery means 500 for recovering an ink discharging function of the recording head are disposed in a confronting relation to the recording head. The recovery means 500 serve to maintain a good recording condition of the recording head by recovering ink clogging and have a cap and pumping means. Further, in place of the ink cartridge 203, a recording head and an ink tank may be provided independently.

Incidentally, according to the illustrated embodiment, in an ink discharging arrangement, an electrical/thermal converter is energized in response to a recording signal to generate thermal energy by which film boiling is generated in the ink, and the recording is effected by discharging the ink from a discharge port of the recording head by growth and contraction of a bubble generated by the film boiling. Regarding representative construction and principle, it is preferable that a fundamental principle is used, for example, as disclosed in U.S. Pat. No. 4,723,129 or No. 4,740,796. Although this system can be applied to both so-called on-demand type and continuous type, particularly, the on-demand type is effective because, by applying at least one drive signal for giving abrupt temperature increase exceeding nucleate boiling and corresponding to recording information to the electrical/thermal converter opposed to the sheet and a liquid flow path holding liquid (ink), thermal energy is generated in the electrical/thermal converter to generate the film boiling on an acting surface of the recording head, thereby forming a bubble corresponding to the drive signal in the liquid. Due to the growth and contraction of the bubble, the liquid is discharged from the discharge port, thereby forming at least one liquid droplet. When the drive signal has a pulse shape, since the growth and contraction of the bubble can be effected promptly and properly, particularly excellent liquid discharging can be achieved. This is more preferable.

(Driving Force Transmitting Arrangement)

Next, a driving force transmitting arrangement for transmitting a driving force to the sheet feeding means 100 and the conveying means such as the conveying roller 302 will be described.

In the illustrated embodiment, a driving force from a pulse motor 305 as a drive source is selectively transmitted to the sheet feeding means 100, conveying roller 302 and recovery means 500 through clutch means 600.

As shown in FIG. 2, the driving force from the pulse motor 305 is transmitted to a conveying gear 303 secured to one end of the conveying roller 302 through a speed reduction gear 306, thereby rotating the conveying roller 302. Further, the driving force can be transmitted to the sheet feeding means 100 and the recovery means 500 by an LF-system output gear 304 secured to the other end of the conveying roller 302.

Figure 3B:
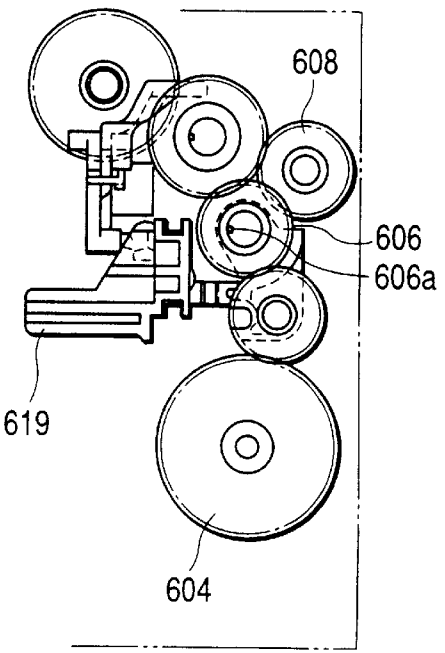
FIGS. 3A, 3B and 3C are explanatory views for explaining a drive transmitting system of clutch means.
Figure 3A:
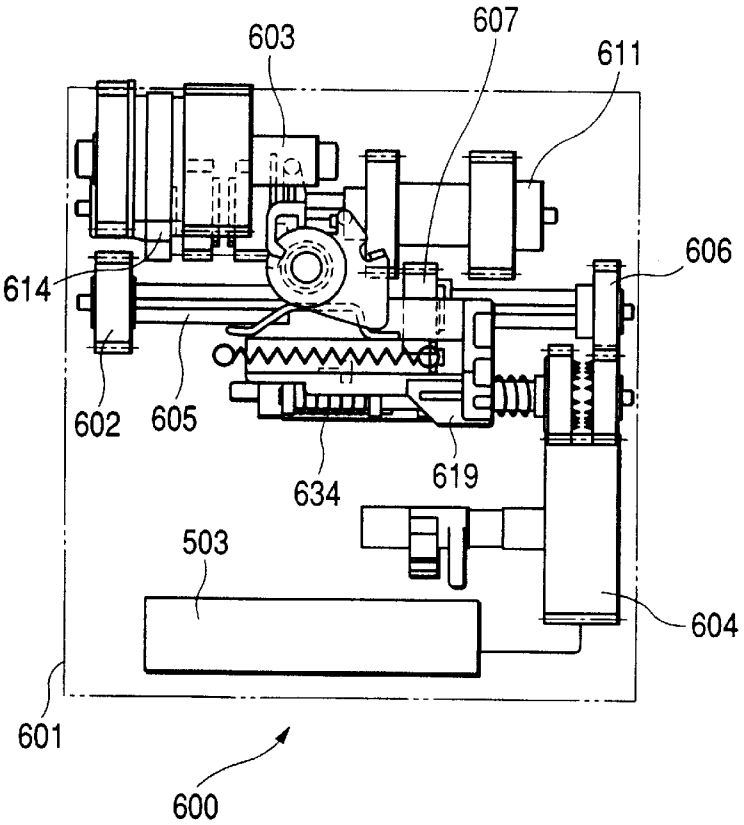
Figure 3C:
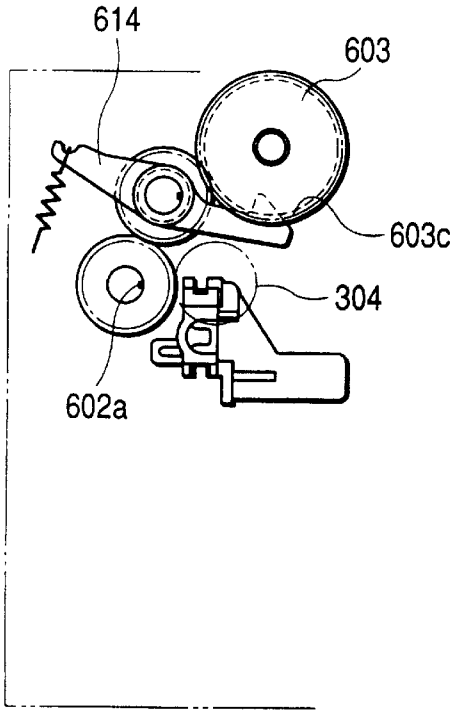

Now, a construction of the clutch means 600 will be fully explained. FIGS. 3A to 3C are explanatory views for explaining a drive transmitting system of the clutch means 600, where FIG. 3A is a plan view, FIG. 3B is a schematic right side view and FIG. 3C is a schematic left side view.

A drive base 601 is provided with an LF-system transmission gear 602 for receiving a driving force from the LF-system output gear 304, an ASF-system output gear 603 for transmitting the driving force to the sheet feeding means 100, and a pump-type output gear 604 for transmitting the driving force to the pump means 503, so that the driving force from the LF-system transmission gear 602 is appropriately connected to or disconnected from the sheet feeding means 100 and the pump means 503 through a clutch mechanism which will be described later.

A driving force switching operation is effected by the shifting movement of the carriage 201. That is to say, normally, although the driving force of the pulse motor 305 is transmitted to only the conveying roller 302, when the pulse motor 305 is driven in a condition that the carriage 201 is in a predetermined position, the driving force is transmitted to the sheet feeding means 100 or the pump means 503, thereby driving the sheet feeding means or the pump means.

Figure 4A:
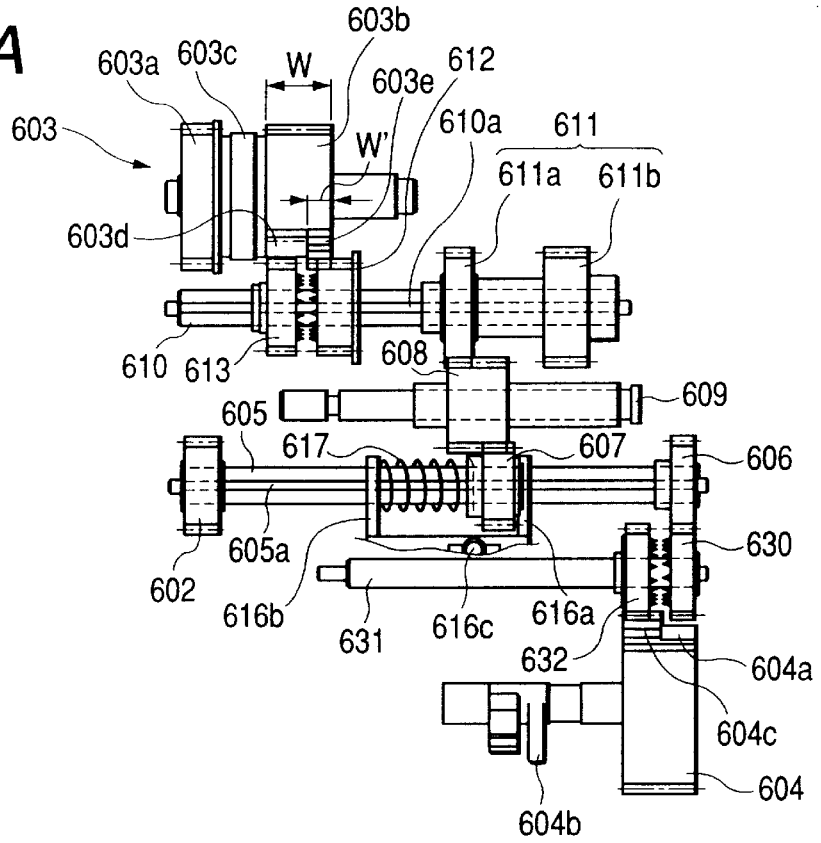
FIGS. 4A and 4B are development views of a gear train.
Figure 4B:
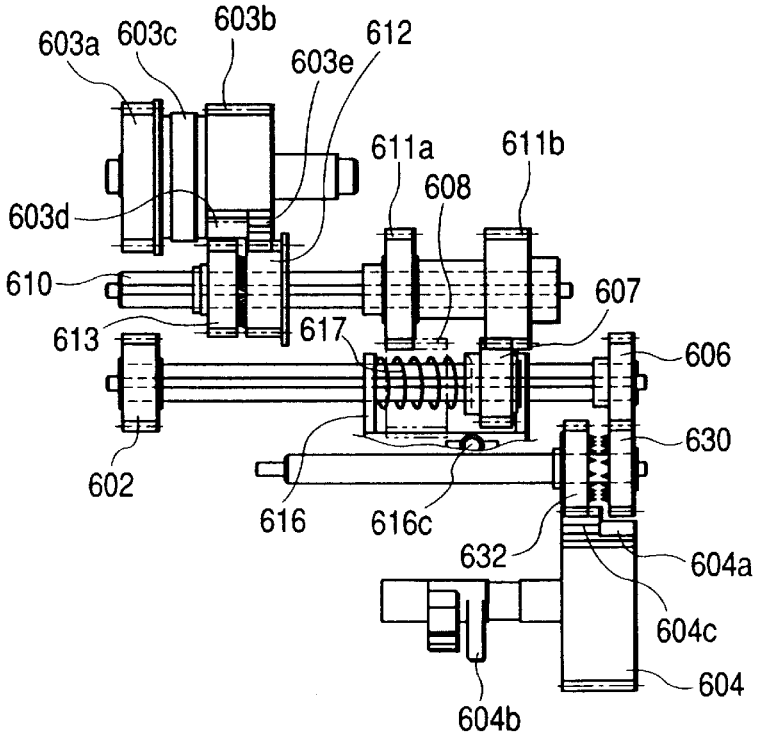

Next, a gear train for transmitting the driving force will be explained with reference to FIGS. 4A and 4B. Incidentally, FIGS. 4A and 4B are development views of the gear train. In FIGS. 4A and 4B, both ends of a transmission shaft 605 having a key way 605*a* are rotatably supported by the drive base 601, and the LF-system transmission gear 602 and a pump transmission gear 606 are mounted on the both ends through key portions 602*a*, 606*a* (FIGS. 3B and 3C) so that these gears cannot be rotated and are fixed with respect to a thrust direction.

Further, a slide gear 607 is mounted on the transmission shaft 605 at a central portion thereof for movement in the thrust direction, and the slide gear cannot be rotated with respect to the transmission shaft 605 by the presence of a key portion but can be rotated together with the transmission shaft. When the slide gear 607 is in a predetermined position, the slide gear is engaged by an idle gear 608 which is attached to the drive base 601 through an idle gear shaft 609.

Further, both ends of an ASF-system clutch shaft 610 having a key way 610a are rotatably supported by the drive base 601, and there are provided a switching gear 611 having two gear portions 611a, 611b, an ASF-system clutch trigger gear 612, an ASF-system clutch gear 613 as an input gear, and a biasing lever 614 (FIGS. 3A and 3C). The switching gear 611 is rotated together with the ASF-system clutch shaft 610 by the presence of a key portion, and two gear portions 611*a*, 611*b* have the same module and the same number of teeth. The gear 611*a* is meshed with the idle gear 608, and, as shown in FIG. 4B, the gear 611*b* is engaged by the slide gear 607 when the latter is shifted.

The ASF-system clutch gear 613 is also rotated together with the ASF-system clutch shaft 610 by the presence of a key portion. On the other hand, the ASF-system clutch trigger gear 612 can freely be rotated with respect to the ASF-system clutch shaft 610 and can be shifted in the thrust direction. The biasing lever 614 is also rotatably mounted on the clutch shaft to regulate the position of the ASF-system clutch gear 613 in the thrust direction (In FIGS. 4A and 4B, the ASF-system clutch gear 613 abuts against the biasing lever 614 (not shown) to further leftward movement of the clutch gear).

An ASF-system output gear 603 having two gear portions and a cam portion is rotatably supported by the drive base 601. A gear 603*a* serves to transmit a driving force to the sheet feeding means 100 and is meshed with an ASF-system input gear 103 (FIG. 2) to serve to transmit the driving force to the sheet feeding roller 102 through 104, 105 (FIG. 2). A gear 603*b* is an output gear meshed with the ASF-system clutch gear 613 and the ASF-system clutch trigger gear 612.

Figure 5:
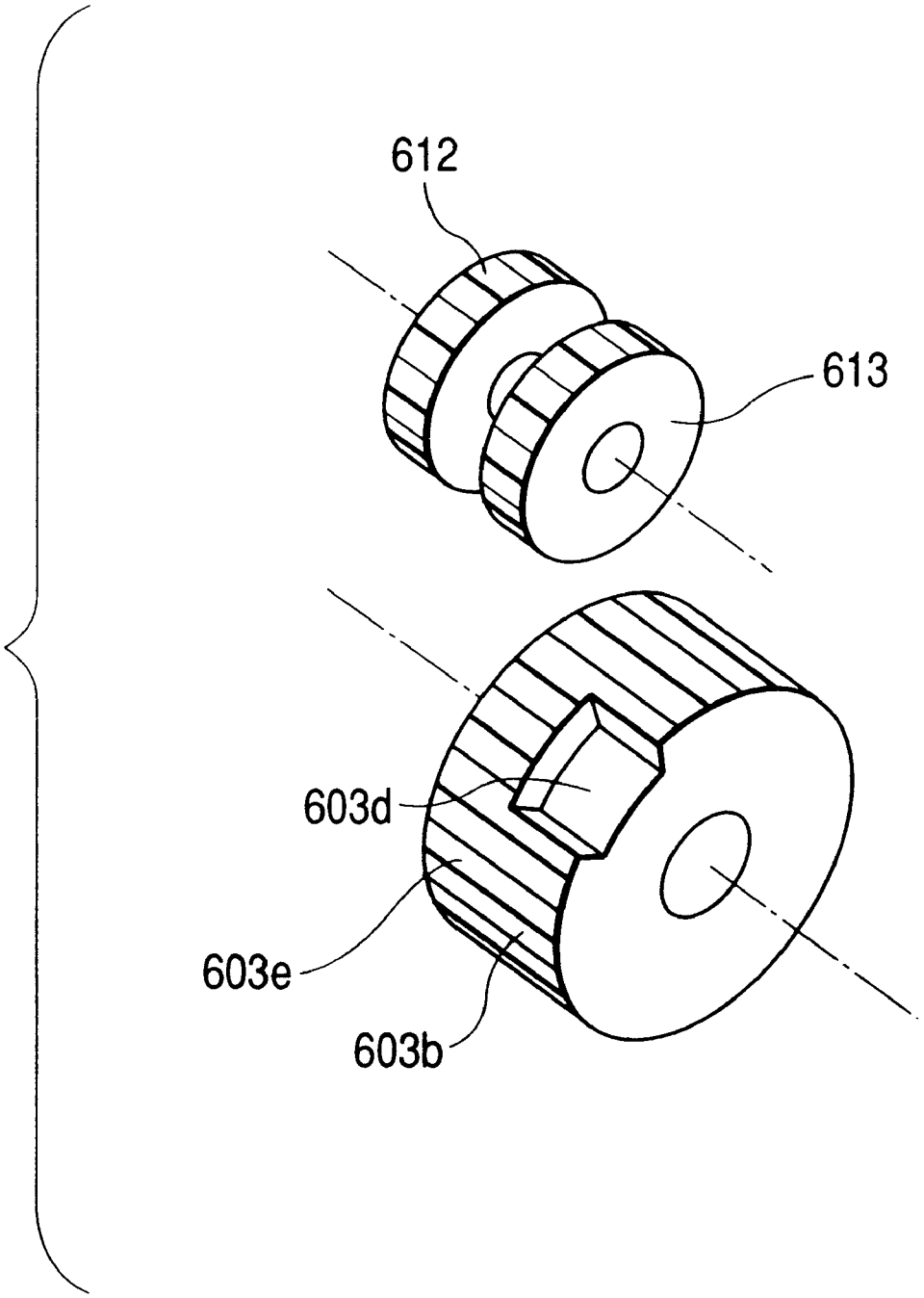
FIG. 5 is a schematic perspective view of a partially non-toothed gear.

FIG. 5 is a schematic perspective view of the partially non-toothed gear. The gear 603*b* has a non-toothed portion 603*d* opposed to the ASF-system clutch gear 613 and obtained by cutting away several teeth with leaving a tooth width w' with respect to an entire tooth width W. That is to say, the gear 603*b* has the non-toothed portion 603*d* obtained by cutting away several teeth in the tooth width-wise direction, and an entirely toothed portion 603*e* having no non-toothed portion.

The biasing lever 614 biased by a spring is engaged by a cam portion 603*c* to regulate the phase of the non-toothed portion 603*d* of the ASF-system output gear 603.

On the other hand, the drive transmission to the pump means 503 is similar to the drive transmission to the sheet feeding means. Namely, the driving force from the LF-system transmission gear 602 is transmitted to the coaxial pump-system transmission gear 606, and a pump-system clutch gear 630 is disposed to mesh with the pump-system transmission gear 606. The pump-system clutch gear 630 is rotatably supported on a pump-system clutch shaft 631 having both ends supported by the drive base 601, and, adjacent to the pump-system clutch gear 630, a pump-system clutch trigger gear 632 is rotatably supported on the pump-system clutch shaft 631 for a shifting movement in the thrust direction. Similar to the ASF-system output gear 603, the pump-system output gear 604 has a non-toothed portion 604*a* and an entirely toothed portion 604*c*, and the non-toothed portion 604*a* is opposed to the pump-system clutch gear 630. Further, a cam portion 604*b* of the pump-system output gear is engaged by biasing means (not shown) to regulate the phase of the non-toothed portion 604*a*.

The slide gear 607 is positioned between regulating walls 616*a* and 616*b* of a slide holder 616 and is always biased toward the regulating wall 616*a* by a spring 617. The slide holder 616 can be shifted along the transmission shaft 605 and the pump-system clutch shaft 631 so that a boss 616*c* can be engaged by a slider 619 (FIGS. 3A and 3B). That is to say, when the slider 619 is shifted, the slide holder 616 is also shifted, thereby shifting the slide gear 607.

The shifting movement of the slider 619 is effected by the shifted carriage 201 abutting and pushing the slider. During the recording operation, the slider 619 and the carriage 201 are not engaged by each other, but, when the sheet feeding operation or the recovery operation is required, the slider 619 is shifted to a predetermined position by the shifting movement of the carriage.

Figures 6A, 6B, 6C, 6D:
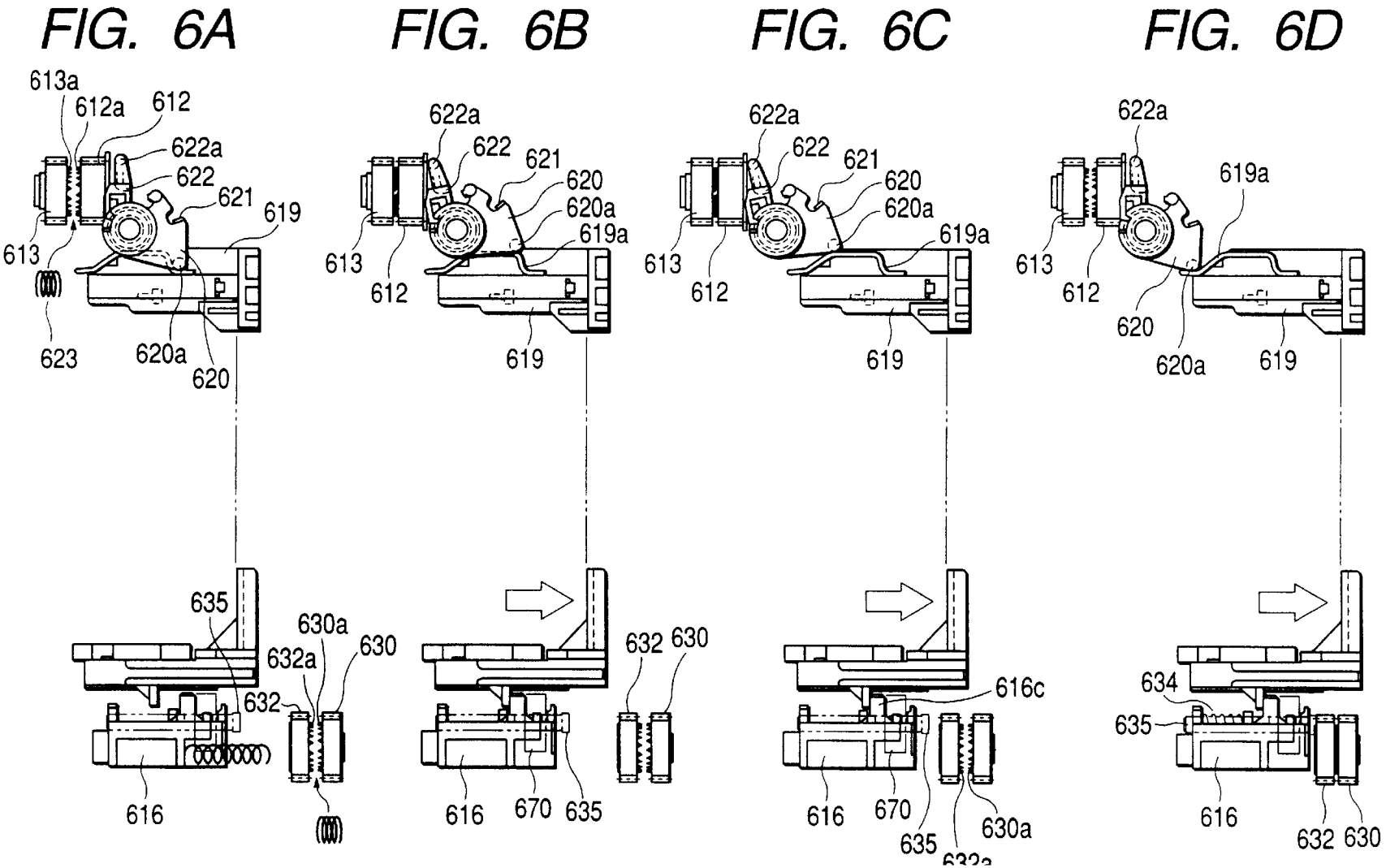
FIGS. 6A, 6B, 6C and 6D are explanatory views showing ON/OFF conditions of a clutch depending upon positions of a slider.

FIGS. 6A to 6D show ON/OFF conditions of the clutch depending upon positions of the slider, and particularly FIG. 6A shows a normal conveying position. In this case, the clutch of the sheet feeding means and the clutch of the pump are both in an OFF condition, and only the conveying roller 302 is driven by the pulse motor 305.

In a first feeding position, as the slider 619 is shifted to a position shown in FIG. 6B, a boss 620*a* of a first trigger lever 620 is rotated along a cam portion 619*a* of the slider 619. The rotation of the first trigger lever 620 acts on a second trigger lever 622 through a trigger spring 621, with the result that the ASF-system clutch trigger gear 612 is pushed by a boss 622*a* of the second trigger lever 622.

A compression spring 623 is disposed between the ASF-system clutch gear 613 and the ASF-system clutch trigger gear 612 to bias these gears away from each other. However, since a spring force of the trigger spring 621 is greater than a spring force of the compression spring 623, the ASF-system clutch trigger gear 612 is shifted toward the ASF-system clutch gear 613 in the thrust direction, with the result that a ratchet portion 612*a* as an engagement portion formed on a side surface of the ASF-system clutch trigger gear 612 is engaged by a ratchet portion 613*a* as an engagement portion formed on a side surface of the ASF-system clutch gear 613.

A displacement amount of the second trigger lever 622 is set to be greater than a displacement amount of the ASF-system clutch trigger gear 612, and a difference in displacement amount is absorbed by the trigger spring 621. Thus, even if the position of the slider 619 is slightly changed due to dimensional errors of parts, the ASF-system clutch gear 613 and the ASF-system clutch trigger gear 612 can positively be engaged by each other.

In a second feeding position, the slider 619 is shifted to a position shown in FIG. 6C, and, similar to the first feeding position, the ratchet portions 613*a*, 612*a* of the ASF-system clutch gear 613 and the ASF-system clutch trigger gear 612 are maintained in the engaged condition. However, the slide gear 607 is shifted by the shifting movement of the slide holder 616, with the result that, as shown in FIG. 4B, the slide gear is disengaged from the idle gear 608 and is engaged by the gear portion 611*b* of the switching gear 611. As a result, in the drive transmitting system, since the idle gear 608 is skipped, the rotational direction of the sheet feeding roller with respect to the conveying roller 302 is reversed in comparison with the first feeding position. That is to say, in the first feeding position, when the conveying roller 302 is rotated to feed the sheet in the normal or forward direction, the sheet feeding roller 102 is also rotated to feed the sheet in the normal direction; whereas, in the second feeding position, when the conveying roller 302 is rotated to feed the sheet in the reverse direction, the sheet feeding roller 102 is rotated to feed the sheet in the normal direction.

When the slider 619 is shifted to a position shown in FIG. 6D, a pump position is obtained. In this position, since the boss 620*a* of the first trigger lever 620 is dropped along the cam portion 619*a*, the ASF-type clutch trigger gear 612 is separated from the ASF-system clutch gear 613 by the compression spring 623, thereby achieving the clutch OFF condition. On the other hand, by the shifting movement of the slide holder 616, a pump-system trigger rod 635 pushes the pump-type clutch trigger gear 632 through a spring 634. As a result, ratchet portions 630*a*, 632*a* as engagement portions of the pump-system clutch gear 630 and the pump-system clutch trigger gear 632 are engaged by each other, thereby achieving the clutch ON condition. Also in this case, a pushing amount of the pump-system trigger rod 635 is set to be greater than a displacement amount of the pump-system clutch trigger gear 632, and a difference therebetween is absorbed by the spring 634. Thus, even if the position of the slider 619 is slightly changed due to dimensional errors of parts, the pump-system clutch gear 630 and the pump-system clutch trigger gear 632 can positively be engaged by each other.

Now, further detailed explanation is made with reference to the clutch means (first clutch means) of the sheet feeding means as an example. Incidentally, since the clutch means (second clutch means) of the pump is similar, explanation thereof will be omitted here.

Figure 7B:
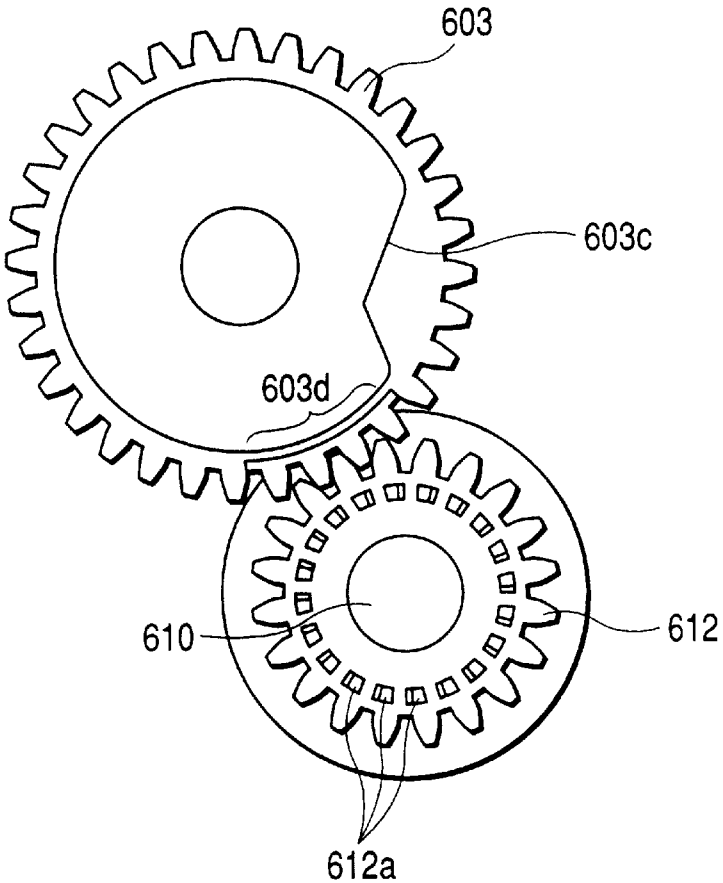
FIGS. 7A and 7B are explanatory views showing a relationship between an ASF-system output gear and an ASF-system clutch gear and an ASF-system clutch trigger gear.
Figure 7A:
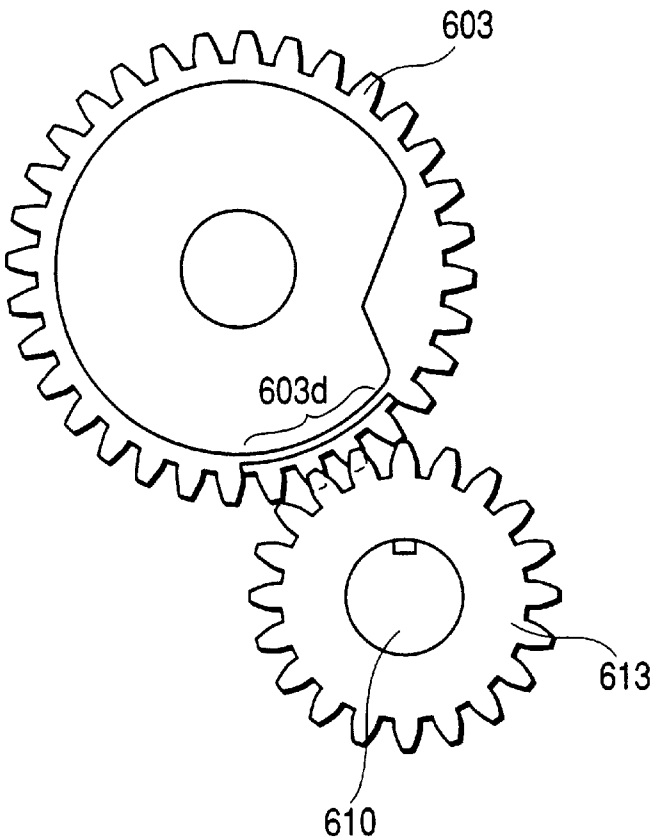

As shown in FIG. 7A, since the ASF-system clutch gear 613 is opposed to the non-toothed portion 603*d* of the ASF-system output gear 603, even when the ASF-system clutch gear 613 is rotated together with the ASF-system clutch shaft 610, the driving force is not transmitted to the ASF-system output gear 603. On the other hand, as shown in FIG. 7B, although the ASF-system clutch trigger gear 612 is always engaged by the ASF-system output gear 603, since the ASF-system clutch trigger gear 612 can freely be rotated with respect to the ASF-system clutch shaft 610, even when the ASF-system clutch shaft 610 is rotated, the ASF-system clutch trigger gear 612 is maintained in the stopped condition. In this case, the cam surface 603*c* of the ASF-system output gear 603 is pushed by the biasing lever 614, thereby preventing inadvertent rotation of the gear (refer to FIG. 3C).

Further, the ratchet portions 613*a*, 612*a* engageable with each other are symmetrically formed on inner surfaces of the ASF-system clutch gear 613 and the ASF-system clutch trigger gear 612 (the ratchet portion 613*a* is formed on a rear surface of the ASF-system clutch gear 613 shown in FIG. 7A) so that, in the condition (clutch ON condition) that the ratchet portions are engaged by each other, when the ASF-system clutch shaft 610 is rotated, the ASF-system clutch gear 613 is rotated to rotate the ASF-system clutch trigger gear 612 through the ratchet portions. As a result, since the ASF-system output gear 603 starts to be rotated, the phase of the non-toothed portion is deviated, thereby engaging the gear 603*b* and the ASF-system clutch gear 613 with each other. Thereafter, if the ASF-system clutch trigger gear 612 is separated, the driving force can be transmitted to the ASF-system output gear 603 only by the ASF-system clutch gear 613. And, when the ASF-system output gear 603 is rotated by one revolution to return the non-toothed portion to the initial phase, the drive transmission is automatically disconnected.

According to this, so long as the phases of the gears and ratchet portions 613*a*, 612*a* of the ASF-system clutch gear 613 and the ASF-system clutch trigger gear 612 are aligned (i.e., so long as the phases of teeth of the ASF-system clutch gear 613 and the ASF-system clutch trigger gear 612 are synchronized when the ratchet portions 613*a*, 612*a* are engaged by each other), since the ASF-system clutch gear 613 and the ASF-system output gear 603 start to be engaged by being guided by the entirely toothed portion 603*e* (having the tooth width W') of the ASF-system output gear 603 (i.e., by rotating the ASF-system output gear 603 by transmitting the driving force to the entirely toothed portion 603*e* engaged by the ASF-system clutch trigger gear 612 ratchet-connected to the ASF-system clutch gear 613), a problem that tops of the teeth of the gears abut against each other to cause poor engagement can be eliminated, and, further, since the ASF-system clutch trigger gear 612 is always engaged by the ASF-system output gear 603, the tops of the teeth do not, of course, abut against each other.

Accordingly, problems regarding noise and out-of-phase of motor can be eliminated, and the positive switching operation can be achieved. Further, since the pushing of the ASF-system clutch trigger gear 612 by means of the carriage 201 only requires a minimum time until the ASF-system clutch gear 613 and the ASF-system output gear 603 are engaged by each other, it is not required that the carriage 201 remains in the trigger position until the ASF-system output gear 603 is rotated by one revolution. Thus, the recording operation is not delayed.

[Second Embodiment]

Next, as a second embodiment of the present invention, a construction of the drive transmitting apparatus for effecting the drive switching more positively will be explained. Incidentally, here, only constructions different from those in the first embodiment will be explained and the same constructions will be omitted from explanation.

In the first embodiment, an example that the ASF-system clutch gear 613 and the ASF-system output gear 603 start to be engaged smoothly by aligning the phase of the gears in the condition that the ratchets of the ASF-system clutch gear 613 and the ASF-system clutch trigger gear 612 are engaged by each other was explained.

However, immediately after, there is a duration in which both the ASF-system clutch gear 613 and the ASF-system clutch trigger gear 612 are engaged by the gear 603*b* of the ASF-system output gear. In this case, if the phases of the gears and ratchets of the ASF-system clutch gear 613 and the ASF-system clutch trigger gear 612 are deviated and the deviated amount is greater than backlash, three gears may be strongly urged against each other to increase rotational load extremely or three gears may be strongly engaged by each other to prevent rotations thereof. Furthermore, the ASF-system clutch trigger gear 612 may not be separated only by the force of the compression spring 623.

Figure 8:
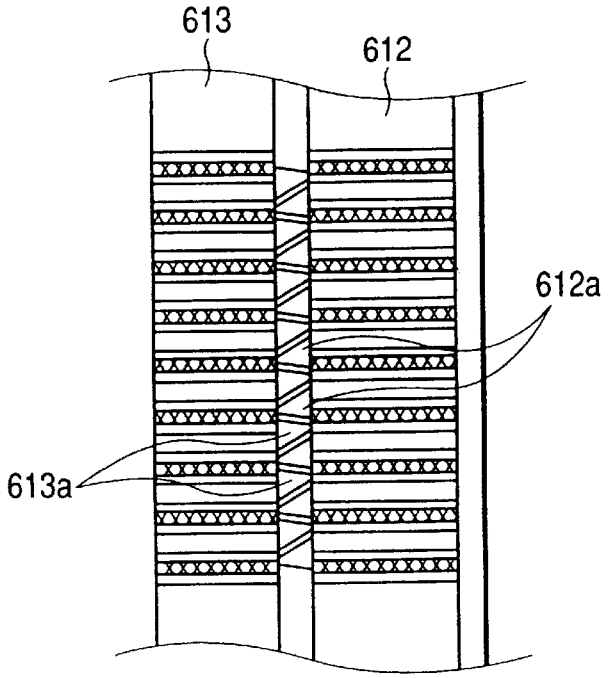
FIG. 8 is a development view of a ratchet portion according to a second embodiment of the present invention.
Figure 9:
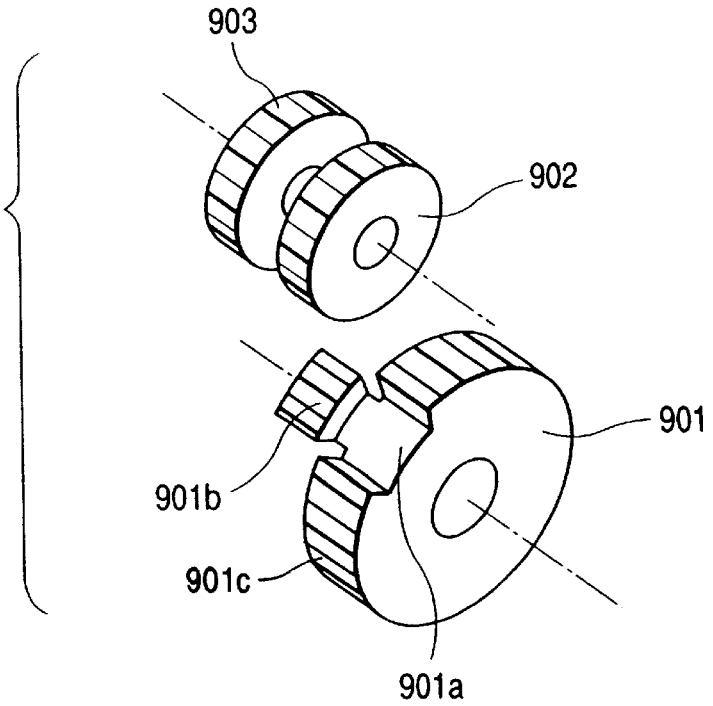
FIG. 9 PRIOR ART
FIG. 9 is an explanatory view showing a conventional technique.

Thus, it is required that a dimensional relationship between the gears and the ratchets be governed severely. However, in the second embodiment, as shown in FIG. 8 which is a development view of the ratchets, by setting so that a gap is created between the ratchets when tooth tips (marking portions) of the ASF-system clutch gear 613 and the ASF-system clutch trigger gear 612 are aligned, the above-mentioned problems can be eliminated.

That is to say, even if the phases of the ratchets and the tooth tips are slightly deviated due to the dimensional errors of parts, since such deviation can be absorbed by the gap, the gears do not abut against each other. On the other hand, however, when the ASF-system clutch gear 613 and the ASF-system clutch trigger gear 612 are operated in the condition that they are engaged by each other, the tooth tips thereof are deviated by an amount corresponding to the gap due to the set gap. Thus, when the ASF-system clutch gear 613 and the ASF-system output gear 603 start to be engaged by each other, deviation will occur. However, so long as the deviation amount is smaller than about ¼ of the circular pitch of the gear (dimension corresponding to ¼ of circumference of one gear), the tooth tips do not abut against each other to achieve the positive engagement. With this arrangement, without governing of the several dimensional errors of parts, since the positive switching operation can be effected, the manufacturing cost can be reduced.

[Third Embodiment]

In the above-mentioned embodiments, while an example that the ink jet recording system is used as the recording system of the image forming apparatus was explained, the recording system of the image forming apparatus using the above-mentioned drive transmitting apparatus is not limited to the ink jet recording system, but a thermal transfer recording system, a heat-sensitive transfer recording system or an impact recording system may be used.

Further, the above-mentioned drive transmitting system can be applied to other apparatus such as an image reading apparatus in which an original is fed to a reading position and information on the original is read by reciprocally shifting a carriage having a reading sensor thereon, as well as the image forming apparatus.

According to the above-mentioned embodiments explained in detail, by aligning the phases of the gears and the engagement portions of the input gear and the trigger gear, the tooth tips do not abut against each other in engagement between the input gear and the output gear. Thus, the positive switching of the driving force can be achieved without the noise and the poor drive transmission from the drive source (for example, out-of-phase of the motor).

Further, when the trigger gear is operated by the shifting movement of the carriage, since the pushing time of the trigger gear is minimum, the recording operation is not delayed.

What is claimed is:

1. An image forming apparatus having a drive transmitting apparatus for selectively transmitting a driving force from a drive source to a driving member through clutch means, said apparatus comprising:

head holding means for holding a recording head;

an output gear having a non-toothed portion not including a predetermined number of teeth in a tooth width-wise direction and an entirely toothed portion having no non-toothed portion;

an input gear disposed at a position where it can be opposed to said non-toothed portion of said output gear and rotated by a driving force from said drive source;

a trigger gear meshed with said entirely toothed portion of said output gear and rotatable with respect to a rotary shaft and movable in a thrust direction so as to contact with and separate from said output gear; and engagement portions provided on opposed side surfaces of said input gear and said trigger gear and engageable with each other, wherein when said input gear and said trigger gear are engaged by each other through said engagement portions, phases of gears of said input gear and said trigger gear are synchronized.

2. An image forming apparatus according to claim 1, wherein said engagement portions comprise ratchets having symmetrical configuration and engageable with each other, and, a gap is created between said ratchets when the phases of said input gear and said trigger gear are aligned.

3. An image forming apparatus according to claim 2, wherein the gap is smaller than ¼ of circumference of the gear.

4. An image forming apparatus according to claim 1, wherein the gap is smaller than ¼ of a circular pitch of the gear.

5. An image forming apparatus according to claim 1, wherein drive switching of said drive transmitting apparatus is effected by shifting said head holding means and abutting said head holding means against said drive transmitting apparatus.

6. An image forming apparatus according to claim 1 or 2, wherein said recording head is an ink jet recording head for discharging ink.

7. A drive transmitting apparatus for selectively transmitting a driving force from a drive source to a driving member through clutch means, said apparatus comprising:

an output gear having a non-toothed portion not including a predetermined number of teeth in a tooth width-wise direction and an entirely toothed portion having no non-toothed portion;

an input gear disposed at a position where it can be opposed to said non-toothed portion of said output gear and rotated by a driving force from said drive source;

a trigger gear meshed with said entirely toothed portion of said output gear and rotatable with respect to a rotary shaft and movable in a thrust direction so as to contact with and separate from said output gear; and engagement portions provided on opposed side surfaces of said input gear and said trigger gear and engageable with each other, wherein when said input gear and said trigger gear are engaged by each other through said engagement portions, phases of gears of said input gear and said trigger gear are synchronized.

8. A drive transmitting apparatus according to claim 7, wherein said engagement portions comprise ratchets having symmetrical configuration and engageable with each other, and, a gap is created between said ratchets when the phases of said input gear and said trigger gear are aligned.

9. A drive transmitting apparatus according to claim 8, wherein the gap is smaller than ¼ of a circular pitch of the gear.

10. A drive transmitting apparatus according to claim 8, wherein the gap is smaller than ¼ of circumference of the gear.

* * * * *

UNITED STATES PATENT AND TRADEMARK OFFICE

CERTIFICATE OF CORRECTION

PATENT NO. : 6,334,725 B1
DATED : January 1, 2002
INVENTOR(S) : Miyauchi

It is certified that error appears in the above-identified patent and that said Letters Patent is hereby corrected as shown below:

Column 2,
Line 25, "gear 903" should read -- gear 902 --.

Column 3,
Line 32, "gear and" should read -- gear, --.
Line 50, "(Construction" should begin a new line.

Column 4,
Line 22, "is" should read -- be --.

Column 5,
Line 67, "with" should read -- and --.

Column 8,
Line 39, "that" should read -- in which --.
Line 51, "remains" should read -- remain --.
Line 61, "that" should read -- in which --.

Column 10,
Line 3, "minimum," should read -- minimal, --.
Line 33, "configuration" should read -- configurations --.

Column 11,
Line 11, "configuration" should read -- configurations --.

Signed and Sealed this

Twenty-third Day of April, 2002

*Attest:*

*Attesting Officer*

JAMES E. ROGAN
*Director of the United States Patent and Trademark Office*